US008753010B2

(12) United States Patent
Bruns

(10) Patent No.: US 8,753,010 B2
(45) Date of Patent: Jun. 17, 2014

(54) GUSSETED BAG WITH CARRIER HANDLE

(75) Inventor: Thomas Bruns, Ibbenbühren (DE)

(73) Assignee: Peel Plastic Products Limited, Brampton, Ontario (CA)

( * ) Notice: Subject to any disclaimer, the term of this patent is extended or adjusted under 35 U.S.C. 154(b) by 11 days.

(21) Appl. No.: 13/517,093

(22) PCT Filed: Dec. 17, 2010

(86) PCT No.: PCT/DE2010/001486
§ 371 (c)(1),
(2), (4) Date: Jul. 22, 2012

(87) PCT Pub. No.: WO2011/072659
PCT Pub. Date: Jun. 23, 2011

(65) Prior Publication Data

US 2012/0275728 A1 Nov. 1, 2012

(30) Foreign Application Priority Data

Dec. 19, 2009 (DE) ..... 20 2009 017 081 U

(51) Int. Cl.
*B65D 33/06* (2006.01)
*B65D 30/20* (2006.01)

(52) U.S. Cl.
USPC ..... 383/17; 383/26; 383/28; 383/120

(58) Field of Classification Search
USPC ..... 383/26, 28, 21, 14, 17, 120
See application file for complete search history.

(56) References Cited

U.S. PATENT DOCUMENTS

| | | | | |
|---|---|---|---|---|
| 3,208,492 | A * | 9/1965 | Braithwaite | 383/8 |
| 7,866,885 | B2 * | 1/2011 | Kujat et al. | 383/6 |
| 8,267,579 | B2 * | 9/2012 | Kruse et al. | 383/26 |
| 8,322,923 | B2 * | 12/2012 | Gum | 383/26 |
| 2009/0022430 | A1 * | 1/2009 | Hutchison et al. | 383/9 |

FOREIGN PATENT DOCUMENTS

| | | | | |
|---|---|---|---|---|
| CA | 2639540 | A1 | 1/2009 | |
| DE | 4220474 | A1 * | 1/1994 | B65D 33/10 |
| DE | 202007016303 | U1 | 3/2009 | |
| EP | 1792722 | A1 | 6/2007 | |
| EP | 2039620 | A1 | 3/2009 | |

OTHER PUBLICATIONS

Machine translation of European Document No. 2 039 620. Translated on Sep. 23, 2013.*

* cited by examiner

*Primary Examiner* — Jes F Pascua
(74) *Attorney, Agent, or Firm* — Stuart L. Wilkinson

(57) ABSTRACT

A packaging container, in particular a gusseted bag, has a container wall for wrapping filling material and a carrier handle arranged with its handle ends on the container wall. The carrier handle (18, 31) is a carrier strip, with handle ends (19, 20, 32, 33) that are routed via openings (21, 22, 34, 35) in the container wall (2) into the inside of the container. The handle ends in the vicinity of the openings have cutouts (23, 23', 24, 24', 36, 36') that respectively reduce the carrier strip width. End sections (25, 26, 38, 39) of each handle end (19, 20, 32, 33) are routed into the inside of the container and are turned over such that the openings (21, 22, 34, 35) in the container wall (2) are covered from the inside. Each folded end section (25, 26, 38, 39) is sealed to the container wall by a one joint seam (27, 27', 40, 40') which runs at a distance to the respective opening.

7 Claims, 4 Drawing Sheets

GUSSETED BAG WITH CARRIER HANDLE

FIELD OF THE INVENTION

The invention relates to a packaging container, particularly a gusseted bag, with at least one container wall that wraps the filling material and with at least one carrier handle which is arranged with its handle ends on the container wall.

DESCRIPTION OF RELATED ART

Known packaging containers are gusseted bags or flat bottom bags of a flexible material in particular of a composite plastic film, which are used to wrap a wide variety of bulk goods and/or filling material, such as animal feed, granular materials, or even liquid products in various packing quantities. The packaging containers are used in the feedstuffs industry among other things, in the chemical industry, or in the food industry, in order to enable the storage or the transportation of intermediate products before they are being further processed, for example, or to be able to offer a finished end product for sale. For this purpose, these types of packaging containers normally have a container wall that wraps around the bulk goods and filling materials by means of at least one wall on the front and on the back of the container are developed. The packaging container can be designed as a packaging bag from plastic film that can be torn open, or as a plastic bag with a re-sealable closure that is arranged in its top section between the front or the back wall of the bag. In addition, in gusseted bags, between the longitudinal sides of the front and the back wall there are normally gussets provided that connect the front and the back wall with each other respectively, with the help of which a larger filling volume can be achieved and an advantageous packaging form for simplified stacking is attained. Flat bottom bags on the other hand have a bottom piece that is inserted between the front and the back wall. For the improved handling of the packaging container, it has a carrier handle in the vicinity of its container wall, where said handle is arranged with its handle ends on the outside of the container wall, for example.

In packaging containers, whose handle ends of the carrier handle are attached on the exterior side of the front and the back wall of the container, for example, the application of the handle ends on the front and back walls of the packaging containers which frequently have color printing on it, has a negative effect on the overall visual appearance. Moreover, the carrier handles which particularly protrude in the vicinity of the lateral edges of the front and the back wall, make it considerably more difficult to stack the packaging containers when they are still empty.

It is desirable to improve a packaging container of the previously mentioned type to the extent that an improved stackability is reached of the packaging containers when they are still empty and at the same time create a packaging container intended for the sale of goods that has an appealing visual appearance.

SUMMARY OF THE INVENTION

With a packaging container, in particular a gusseted bag, with at least one container wall that wraps the filling material and with at least one carrier handle which with its handle ends is arranged on the container wall, it is provided according to the invention that the carrier handle is a carrier strip, the handle ends of which are routed into the inside of the container via openings in the container wall, where the handle ends in the vicinity of the openings have cutouts which respectively reduce the carrier strip width, that an end section of each carrier end that is routed into the inside of the container is turned over such that the openings in the container wall are covered from the inside, and that at least each folded over end section is determined by means of at least one joint seam which runs at a distance to the respective opening.

Such packaging container that is designed according to the teaching of the invention, the carrier handle of which is designed as a carrier strip and in particular runs parallel to the container wall of the packaging container and therefore does not project and/or protrude from a side seam that connects the gusset with the front wall, for example, can be stacked without problems even still in the unfilled state. The handling of such packaging containers, in particular prior to a potential filling procedure, is therefore simplified in an advantageous manner. For this purpose, the carrier strip designed as a carrier handle preferably has a handle that loosely bears against the exterior of the container wall so that it can be easily gripped with one hand. The handle ends which are routed through the openings in the container wall into the inside of the container furthermore extend into opposite directions over a certain section. Each handle end furthermore has a turned-over end section which then extends into the opposite direction, so that the end sections are facing each other and that the opening in the container wall that is assigned by means of a respective turned-over end section is furthermore covered from the inside. In this context, a double layer handle end section is created at least from the folding edge up to the opening on the inside of the container wall. The turned-over and/or folded end sections typically extend somewhat beyond the openings, so that these can be connected without problems using at least one joint seam preferably to both longitudinal sides of the openings developed for the handle ends with the preferably weldable inside of the container wall. The carrier strip furthermore has cutouts that reduce the carrier strip width in the vicinity of each opening, so that the openings can be designed smaller than the width of the carrier strip and are thus always completely covered by the respectively wider carrier strip ends.

According to a development of the invention it is advantageously provided that the joint seam is a self-contained ring seam that surrounds the associated opening. The ring seam design has the advantage that in addition to the permanently solid and therefore safe material closure by adhesive force between the carrier strip and the container wall an advantageous tight closure is ensured in the vicinity of each opening by means of the joint seam running around the periphery. The self-contained joint seam preferably runs in a rectangular course, wherein also other developments such as an annular course are conceivable, for example. Each joint seam is based upon a material closure between the handle ends and the inside of the container wall, but where in this context both a welding seam as well as also a adhesive seam can be provided.

The joint seam can at the same time be reinforced by at least one reinforcing seam which has at least one seam section that runs approximately parallel to the respective opening. The use of such a reinforcing seam has the advantage that an improved transfer of forces into the container wall is possible by means of the carrier handle that connects the connection area with the container wall. Therefore also greater holding and carrier forces can be absorbed by means of the reinforced connection area without any problems. The reinforcing seam that reinforces the joint seam can be developed both as a joint seam that is at least preferably designed as a ring seam and divides the seam section into two approximately equally sized areas, as well as a seam connection that increases the connection area, for example. In this case, the reinforcing seam is designed approximately U-shaped and preferably joins directly onto the joint seam. Each reinforcement seam can be created during the attachment of the carrier handle on the container wall together with the joint seam or also in a separate processing step subsequent to the creation of the joint seam.

A development of the invention provides that the carrier handle is preferably arranged running transverse to the longitudinal direction of packaging. Therefore, a carrier handle that is designed as a carrier strip runs approximately at a right angle to the longitudinal sides of the front and rear wall of the container. In this case, the carrier strip width can be optimally adapted to the mass of the filling material to be wrapped by means of the packaging container, wherein it is also conceivable to provide two such carrier strips as taught by the invention, one of which is and arranged on the upper and one on the lower end of the packaging container, in each case.

With a carrier strip that extends transverse in relation to the side edges of the front and the rear wall it can be provided that the carrier strip has cutouts that are developed as grips that again run parallel to the longitudinal direction of the packaging container in the carrier strip. The design of such cutouts as taught by the invention in a carrier strip should be preferably done above a certain packaging size and a therefore necessary widening of the carrier strip that has to be made. As a result, the safe handling during the transportation or during the emptying of the filling material from the packaging can be further improved. The cutouts can be designed as an oval or also shaped as a longitudinal slot.

Alternatively to a transverse orientation of the carrier handle there is the possibility that the carrier handle is arranged running parallel to the longitudinal direction of the gusset, whereby a simple arrangement of a carrier handle in the vicinity of a front wall or a gusset can be implemented, for example. The width of the carrier strip to be used can vary depending on the dimensions of the packaging container as taught by the invention or the mass of the bulk goods or filling material accommodated by means of the packaging container. But the width of the carrier strip in this form of design is limited by the ergonomic dimensions of a hand, so that in this case the potential maximum width of the grip is limited. The orientation of the carrier strip parallel to the longitudinal sides of the front and the rear wall of the container makes it possible, however, to adapt the length of the carrier strip individually in relation to the specified conditions of use.

The openings are preferably arranged and/or inserted in at least one surface area of the container wall forming the gusset, so that an advantageous handling of the packaging container is possible from a relatively small side area. During the handling of such packaging container designed as taught by the invention by means of its carrier handle, its longitudinal axis is oriented correspondingly parallel normal to the surface, which simplifies both the transportation as well as the discharge process of a packaging container that normally has its largest dimensions in its longitudinal direction.

The openings in particular have a slot-like design, which represents an advantageously simple possibility for designing the insertion openings for the handle ends which penetrate the container wall. The introduction of the openings in the container wall, principally in one of the gussets developed by the container wall, can be done with the help of an advantageous processing step, such as with a cutting process. The openings can obviously also be designed as punched perforations, so that then a rectangular or oval surface area of the container wall for forming the openings is removed, for example.

The carrier strip is preferably a tubular film formed from plastic sheeting, where the tubular design ensures improved carrying characteristics because of the double layer sliding on top of each other. In addition, using the two-layer carrier strip, it is possible to obtain relatively high holding forces and/or carrier forces. For developing a tubular film, particularly a folded filmstrip is used, the layers of which are lying on top of each other particularly in the vicinity of the side edges and in case of grips provided in the carrier strip are also welded to each other in the vicinity of the openings. It is obviously also possible to use a single layer filmstrip which can then primarily be used with smaller packaging dimensions and/or with packaging containers for relatively low density bulk materials.

BRIEF DESCRIPTION OF THE DRAWINGS

Potential embodiments of the invention from which further inventive features result are illustrated in the drawing, as follows:

FIG. 1 shows a packaging container 1 known from prior art, developed as a gusseted pouch or bag, which has a container wall 2 for wrapping filling material to be transported using the packaging container. A container wall 2 includes a front wall 3 and a back wall 4, and the front and back wall 3, 4, are joined along their longitudinal sides by gussets, 5, 6, that are connected to each other. The front wall 3 and the back wall 4 at their lower end are connected to each other by means of a bottom seam 8 to form a closed container bottom 7. The gussets 5, 6, have side seams 9, 10, 11, which are designed as welding seams that are connected with the front and the back walls 3, 4, in each case, for example. In the top area 12 of the packaging container 1, particularly between the front and the back wall 3, 4, a re-closable means 13 such as a zipper or a slider closure is provided, by means of which the filling material that is within the packaging container can be discharged in portions. In addition, the packaging container 1 is equipped with a carrier handle 14 which extends between the longitudinal sides of the front and the back wall 3, 4, and thereby completely over the side gusset 5. Handle ends 15, 16, are arranged on the outside of the front wall 3 and back wall 4 forming parts of the container wall 2, where the handle ends 15, 16, are respectively bonded to the outer surfaces of the front wall 3 and the back wall 4.

FIG. 2 shows a packaging container 17 in the vicinity of the carrier handle 18 according to an embodiment of the invention, which preferably has the form of a carrier strip and is arranged on a front or back wall 3, 4, and extends transversely in relation to the longitudinal direction of the packaging. The handle ends 19, 20, of the carrier handle 18 are routed via openings 21, 22, into the inside of the packaging container 17, wherein each handle end 19, 20, in the vicinity of the respective opening 21, 22, has cutouts 22, 23', 24, 24', which reduce the carrier strip width. Accordingly, each opening can have smaller dimensions than the carrier strip, relative to its width. The handle ends 19, 20, have end sections 25, 26, which are folded over in opposite directions so that the end sections are facing each other and furthermore cover and or/the hide the openings 21, 22, starting from the inside of the front or the back wall 3, 4. In addition, each turned-over end section 25, 26 is closed with adhesive force by means of at least one joint seam 27, 27' with the inside of the gusset. Each joint seam 27, 27' is always developed running at a distance to the respective opening. Preferably, each joint seam 27, 27' is a self-contained ring seam which surrounds the opening, so that the inside of the container is securely separated from the external environment. The joint seam 27, 27' is furthermore reinforced by at least one reinforcement seam 28, 28' that runs approximately parallel to a respective slot-like opening, that is arranged adjacent to a respective opening 21, 22 and ensures an improved transfer of forces in the connection area. The carrier handle 18 which runs transverse furthermore has cutouts 29, 29' serving as grips to improve the carrying comfort.

FIG. 3 shows a further embodiment of a packaging container 30 as taught by the invention, which, as in the previous embodiment, has a carrier handle 31 which runs transverse to the longitudinal sides of the front and back wall 3, 4. The handle ends 32, 33 of same are however run via openings 34, 35 in the gusset 5 into the inside of the container as taught by the invention, where the carrier handle 31 preferably lies flat on the gusset 5. In addition, this carrier handle 31 has cutouts 36, 36' in the vicinity of the openings 34, 35 and has cutouts 37, 37' that are developed as grips for a hand. The end sections 38, 39 of the handle ends 32, 33 are folded over just as in the first embodiment, so that a double layer handle end section results. Both handle ends 32, 33 are in turn integrally connected with the inside of the gusset 5 with the help of at least one joint seam 40, 40'. Identical components have identical reference numbers.

FIG. 4 shows a further possible embodiment for a packaging container 41 as taught by one embodiment of the invention. The packaging container 41 is developed as a gusset pouch which in this embodiment has a carrier handle 42 that is arranged on its gusset 5, which contrary to the previously shown embodiments is arranged running in the longitudinal direction of the packaging. The handle ends (not shown) are likewise routed into the interior of the packaging via openings 43, 44 and are folded there in an identical manner to the embodiment shown in FIG. 2 and are integrally connected with the inside of the gusset 5 via corresponding connection and reinforcing seams. Identical components have identical reference numbers.

Figure 1:
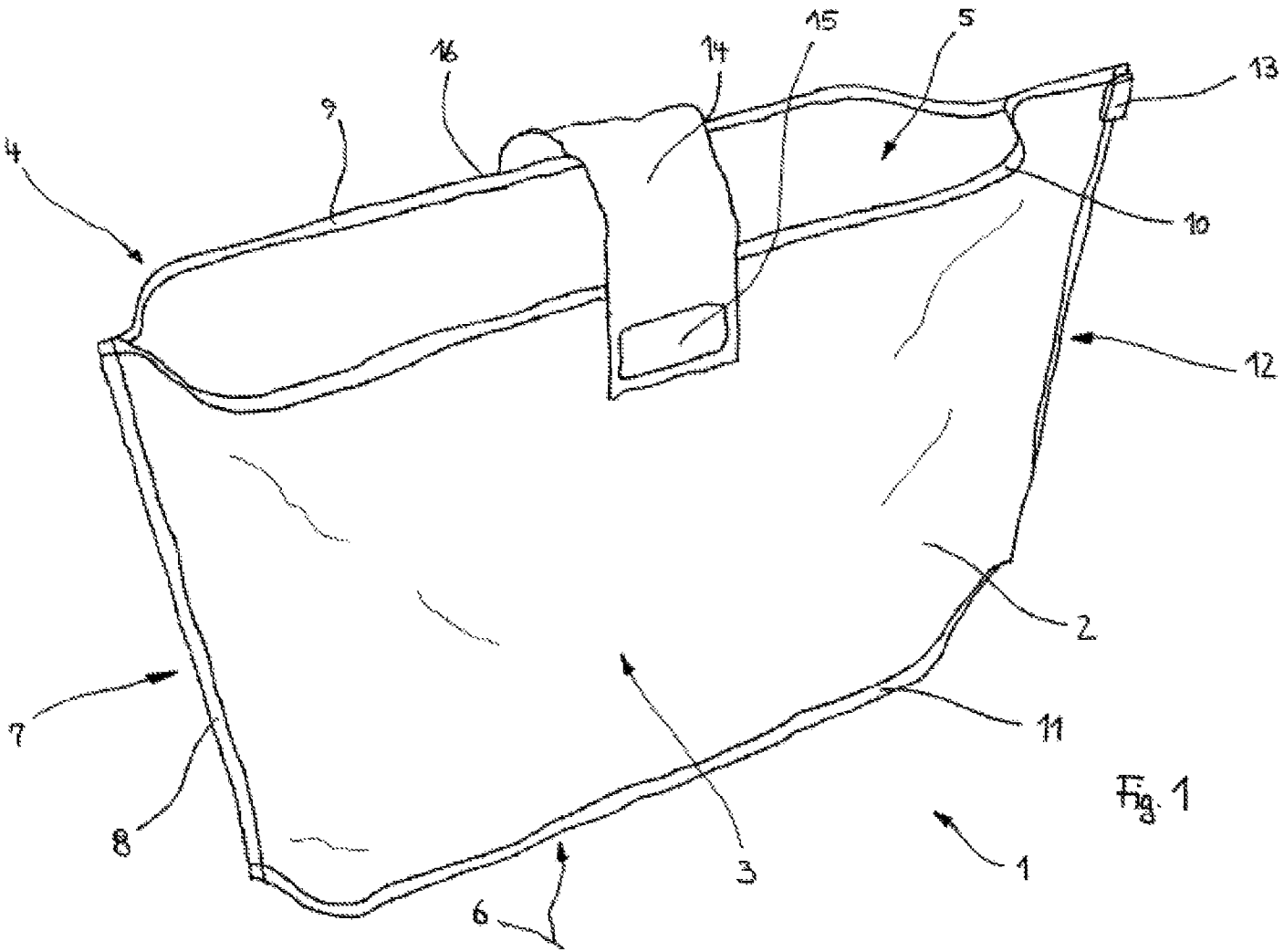
Fig. 1 PRIOR ART
FIG. 1 is a perspective view of a packaging container known from prior art.
Figure 2:
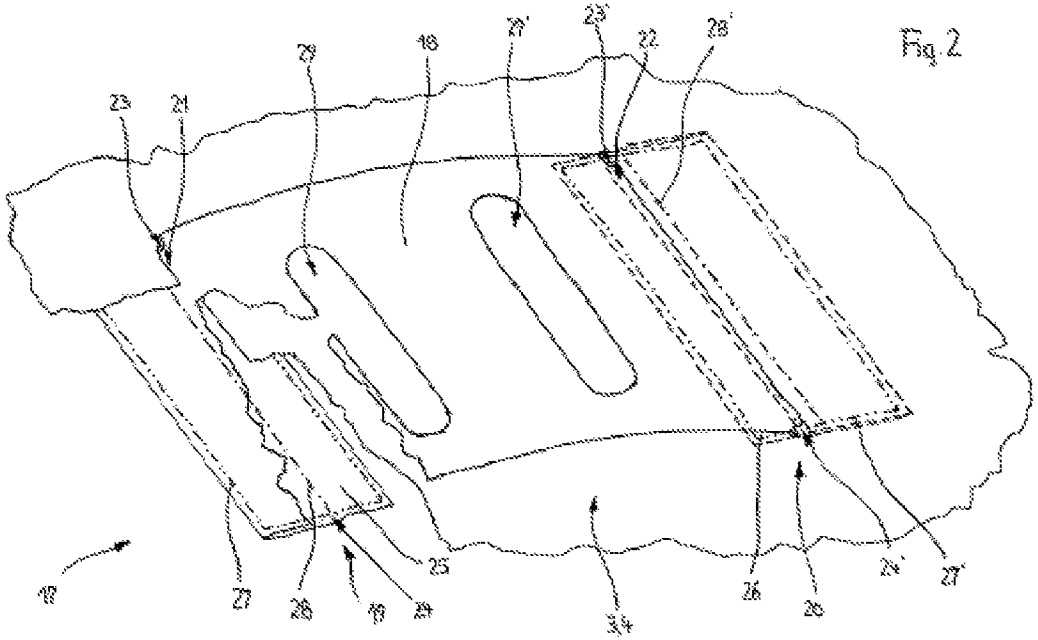
FIG. 2 is a perspective view of a first embodiment of a packaging container in the vicinity of its carrier handle as taught by the invention.
Figure 3:
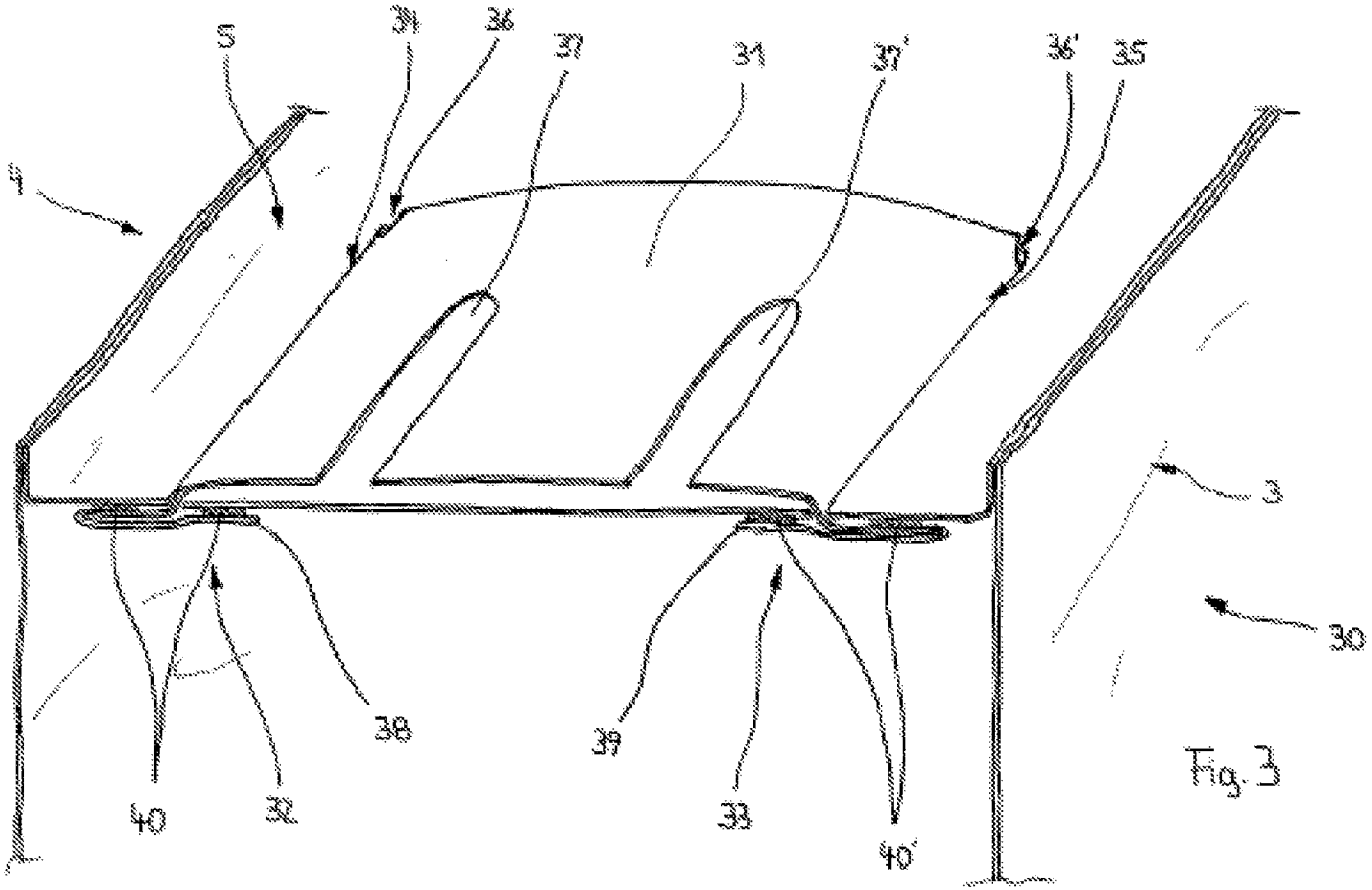
FIG. 3 is a sectional view of a second embodiment of a packaging container as taught by the invention in the vicinity of its carrier handle.
Figure 4:
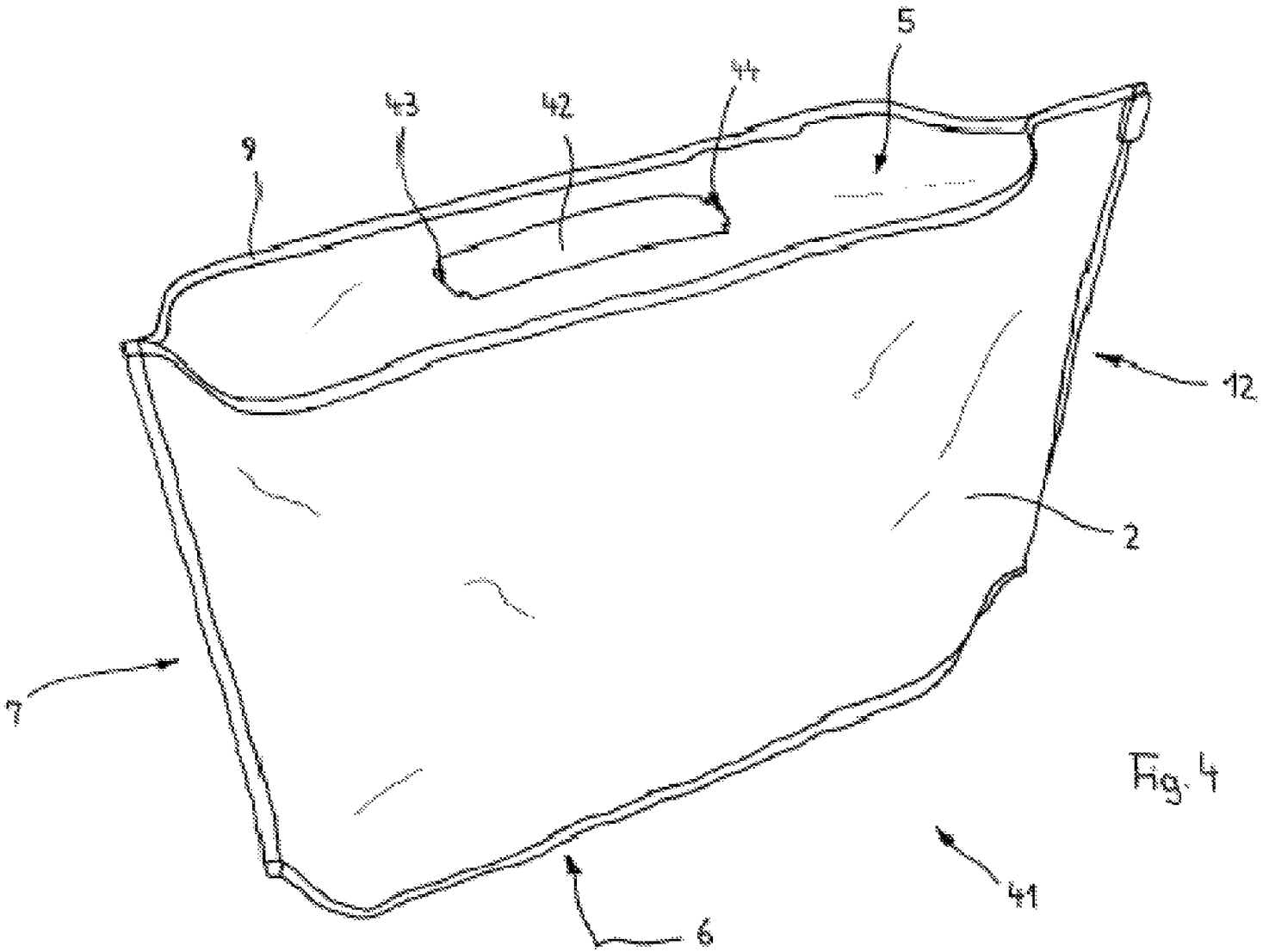
FIG. 4 is a perspective view of a further packaging container as taught by the invention.

What is claimed is:

1. A packaging container comprising a gusseted bag, with at least one container wall for wrapping around a filling material and with at least one carrier handle arranged with handle ends thereof on the container wall, characterized in that the carrier handle (18, 31) is a carrier strip, the handle ends of which (19, 20, 32, 33) are routed via openings (21, 22, 34, 35) in the container wall (2) into the inside of the container, and where the handle ends in the vicinity of the openings have cutouts (23, 23', 24, 24', 36, 36') which respectively reduce the carrier strip width;

one end section (25, 26, 38, 39) of each handle end (19, 20, 32, 33) is turned over such that the openings (21, 22, 34, 35) in the container wall (2) are covered from the inside, and each turned over end section (25, 26, 38, 39) determined by a joint seam (27, 27', 40, 40') which is a ring seam surrounding the respective opening and having an inner boundary spaced from the opening.

2. A packaging container as claimed in claim 1, characterized in that the joint seam (27, 27') is reinforced by at least one reinforcing seam (28, 28'), which has at least one seam section that runs approximately parallel to the respective opening (21, 22, 34, 35).

3. A packaging container as claimed in claim 1, characterized in that the carrier handle (18, 31) is arranged running approximately transverse to the direction of packaging.

4. A packaging container as claimed in claim 3, characterized in that the carrier handle (18, 31) is provided with cutouts (29, 29', 37, 37') that are developed as grips.

5. A packaging container as claimed in claim 1, characterized in that the carrier handle (42) is arranged extending longitudinally to the direction of packaging.

6. A packaging container as claimed in claim 1, characterized in that the openings (43, 44) are arranged in a gusset (5, 6) forming surface areas of the container wall (2).

7. A packaging container as claimed in claim 1, characterized in that the openings (21, 22, 34, 35, 43, 44) are developed as slots.

* * * * *